United States Patent [19]

Wilhelm

[11] 4,001,855

[45] Jan. 4, 1977

[54] RAPID-FLOW WASHER FOR PHOTOGRAPHIC SHEET MATERIAL

[76] Inventor: Henry Gilmer Wilhelm, 723 State St., Grinnell, Iowa 50112

[22] Filed: Mar. 10, 1975

[21] Appl. No.: 556,919

[52] U.S. Cl. ..... 354/324; 134/64 P; 354/331; 354/335

[51] Int. Cl.[2] ..... G03D 3/02

[58] Field of Search ..... 354/297, 324, 325, 328, 354/331, 333, 335, 337, 338, 340, 343, 347; 134/64 P, 122 P

[56] References Cited

UNITED STATES PATENTS

| | | | |
|---|---|---|---|
| 1,035,540 | 8/1912 | Creech | 354/325 X |
| 1,091,687 | 3/1914 | Miller | 354/335 |
| 2,562,588 | 7/1951 | Traiber | 354/324 X |
| 3,077,155 | 2/1963 | Maddock et al. | 354/340 X |
| 3,623,416 | 11/1971 | Anderberg | 354/313 X |
| 3,657,990 | 4/1972 | Wilhelm | 354/331 X |
| 3,816,844 | 6/1974 | Pfefer | 354/328 |
| 3,851,662 | 12/1974 | Jessop | 354/324 X |

*Primary Examiner*—Fred L. Braun
*Attorney, Agent, or Firm*—Max L. Libman

[57] ABSTRACT

A rapid-flow washer for photographic sheet material, such as prints or films, in the form of a tank having a fluid inlet near the bottom including an aerator for introducing a mixture of air bubbles and water into a horizontal distribution manifold at the bottom of the tank, the top of said manifold being a horizontal septum perforated with small perforations, and having also parallel rows of larger perforations for receiving the ends of removable wire sheet separators to thus form parallel rows of such separators spaced far enough apart in the rows to permit manual insertion and removal of single sheets. A vertical septum near one end of the washer provides an overflow compartment at the bottom of which is an outlet nozzle.

6 Claims, 3 Drawing Figures

RAPID-FLOW WASHER FOR PHOTOGRAPHIC SHEET MATERIAL

This invention is an improvement of my U.S. Pat. No. 3,657,990, Apr. 25, 1972, for a Washer for Sheets of Photographic Material. The prior washer was intended primarily for long washing of prints which was necessary for producing permanent archival-type prints which would not degrade with age. The long washing was required because most print papers previously available were made of absorbent paper which permitted the processing and fixing solutions to soak into the paper fibers so that it required prolonged washing in flowing water to remove all traces of these solutions which, if left in the paper, would in time degrade the quality of the print by chemically reacting with the silver photographic image causing it to stain and/or fade.

New photographic paper has become available and will probably ultimately supplant the old style paper; this new paper is provided with a thin coating of water-impermeable plastic on both sides of the paper core. The photographic emulsion is then coated on top of one side of the plastic coated paper core. The new coated paper does not absorb liquid and therefore none of the chemical solutions soak into the paper except negligibly at the cut edges of the paper. This new paper can therefore be washed in much less time than was required for the old type paper. For maximum washing speed with the new coated paper a print washer must have a very high water exchange rate so that the processing chemicals will be carried away at a rate equal to the rate the processing chemicals diffuse from the print emulsion into the washing solution. This requires a by-volume exchange rate of once every 60 seconds or faster. The prints must also be kept constantly separated from each other to permit water to reach all areas of the emulsion surface at all times. The present invention provides a print washer which takes advantage of the rapid-wash capability of the new coated paper and permits a print to be adequately washed so as to produce a permanent print in about four minutes compared with perhaps 60 minutes for the old style non-coated papers.

The prior washer kept the individual prints isolated from each other in separate compartments so that it could be used continuously without a newly inserted print contaminating the almost-finished prints which had been inserted earlier into the adjacent compartments. This is now unnecessary due to the short time required, so that instead of individual compartments in the tank, there is now provided only print separator means for keeping the prints out of direct contact with each other. The new washer also provides removable print separators in the form of wire rods of inverted U-shape spaced far enough apart so that individual prints can easily be inserted or removed by hand or with tongs.

One great danger of contamination with the rapidly washable prints is from drops of processing solutions on the prints themselves, as they are inserted into the washer, adhering to the top edges of the washer tank or separators, and then re-adhering to the washed prints as they are being removed. Special means are provided in the new washer to prevent this by keeping all portions of the washer which can come into contact with the prints (as they are being inserted or removed) below the surface of the washing water, as will be explained in more detail below.

The wire rod separators are readily insertable and removable, and by removing only some of them, the space between them can be adjusted to accommodate thicker objects such as a roll of film, for washing.

The specific nature of the invention, as well as other objects and advantages thereof, will clearly appear from a description of a preferred embodiment as shown in the accompanying drawings, in which.

Figure 1:
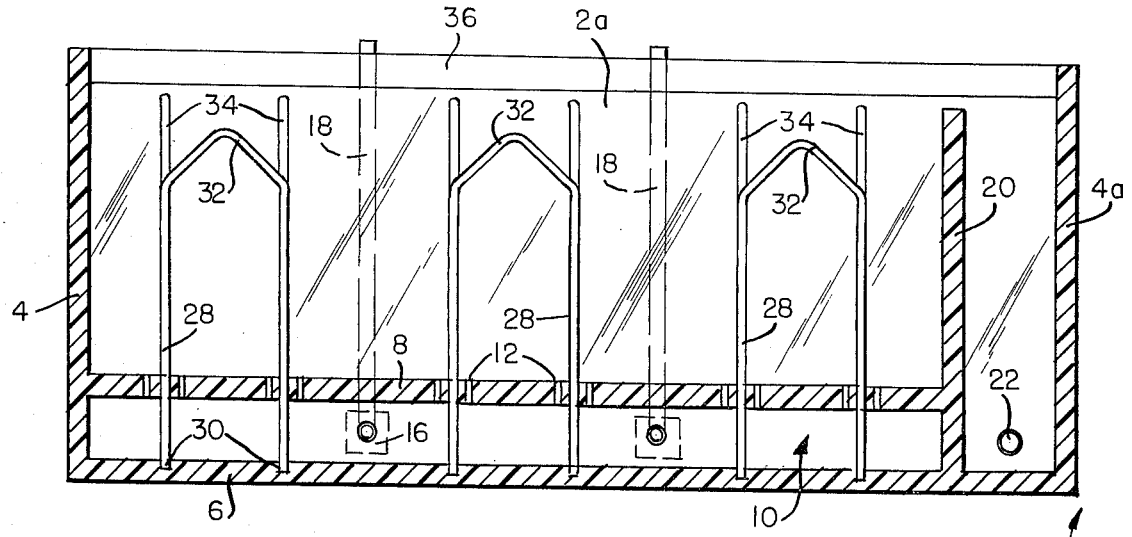
FIG. 1 is a lateral longitudinal sectional view taken on line 1—1 of FIG. 2.

As shown in the Figures, the tank is preferably made of clear plastic, so that the sheets being washed can be observed during the entire process. The tank has a pair of rectangular parallel side walls 2, 2*a*, end walls 4, 4*a*, and a bottom wall 6. A horizontal septum 8 is spaced from the bottom of the tank to provide a fluid distribution manifold 10 having a large number of spaced small perforations 12 for the passage of water from the manifold up into the main tank space above it.

One or more inlet taps 14 admit water through a hose (not shown) to an aerator 16 which draws air from a tube 18 which extends up to at least the top edge of the tank, so that when the tank is full of water, shutting off the inflow will not cause the tank fluid to drain off through the air inlet. The entrained small air bubbles are kept from coalescing rapidly into larger bubbles by the small size of the perforations 12; since the manifold is under some pressure from the inlet fluid, any large bubbles formed are broken up again in passing through the small perforations so that the water in the main tank is well aerated, which is desirable for washing because of the gentle agitation of the prints which water aeration provides.

A vertical septum 20 extends in fluid-tight relation to the side walls near end wall 4*a*, up to a distance which is a little below the top edges of the side walls, and forms between itself and end wall 4*a* a vertical overflow tank space to receive overflow fluid from the main tank without allowing the fluid to spill over the walls of the main tank.

The overflow space is provided with a fluid outlet nozzle 22 to which can be attached a rubber hose so that the discharge fluid can be led to a suitable sink or drain; thus the tank need not itself be placed in a sink as has often been the prior practice. By placing the outlet nozzle at the bottom of the overflow space, the full head of the fluid in this space can be utilized, so that a smaller outlet pipe can be used than if the overflow fluid were conducted away directly from the level at which it overflows.

Figure 2:
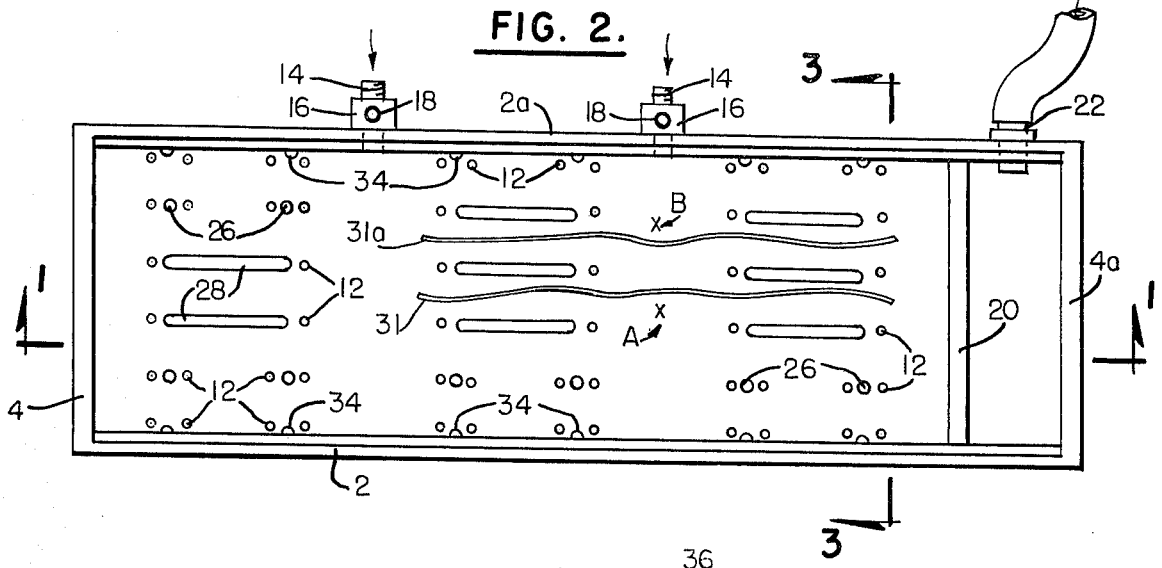
FIG. 2 is a top view of the washer.
Figure 3:
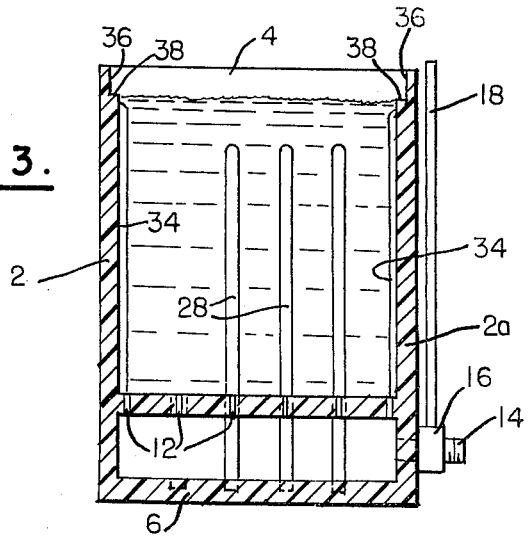
FIG. 3 is a sectional view taken on line 3—3 of FIG. 2.

The horizontal septum 8 is provided with a number of spaced parallel rows or wire receiving apertures 26 of a size to snugly but freely receive the ends of a number of sheet separating elements 28, each shaped like an inverted U, and made of stiff wire of a suitable material such as stainless steel, which is rust-proof and impervious to photographic developing or fixing solutions. In addition, the bottom wall of the tank is preferably provided with recesses 30 to accommodate the extreme ends of the elements 28 so as to hold them firmly in a vertical array when properly inserted into apertures 26 and recesses 30. The arrangement is such as to provide parallel rows of separating elements spaced sufficiently apart to support between any two adjacent rows at least one sheet of photographic material such as a photo print on edge for washing. The tank is preferably made sufficiently large to accommodate two such sheets aligned in a single row, or alternatively, one sheet of larger size, and the width of the U-shaped element is preferably sufficiently narrow so that if desired a very small print can be washed, and will be supported by at least two adjacent wire vertical members on each side. At the same time, the spacing between adjacent wire elements in the same line or row is sufficient — in the order of 2.5 – 3 inches — so that an individual small print can easily be inserted or retrieved by hand or by the use of tongs. The distance between adjacent rows has been exaggerated in the drawing for clarity, and is preferably no more than required to loosely support a single sheet, i.e., in the order of 0.25 inch. If a wider object is to be washed, say a roll of film, some rows of separating elements 28 can readily be removed by hand, as shown in the top and bottom rows of FIG. 2, and thus provide wider spacing between rows.

The small perforations 12 are preferably placed immediately adjacent the larger apertures 26 and in the same line or row with the large apertures. This is very important, as it insures that the entering fluid washes both sides of the separated sheets; since these sheets are very flexible when wet and tend to curve at their bottom edges as shown at 31 and 31*a*, any other placement of the small perforations, for example, as shown at A and B in FIG. 2 might result in no washing water striking the adjacent sides of the prints 31 and 31*a* near these points (A and B), with resulting incomplete washing of the prints. By placing the small apertures near the separating elements as shown, this possibility is prevented.

The topmost points of the inverted U-shaped separating elements 28 are preferably pointed as shown at 32; this facilitates insertion of the sheets into the proper row of separating elements as only one point must be located on the separator, and the sheet will then fall into the correct space.

Along the insides of walls 2 and 2*a* are provided a series of vertical ridges 34 to prevent the sheets in these rows from adhering to the walls 2, 2*a* and not being completely washed. Small perforations 12 are also placed on each side of these ridges to assure the flow of washing fluid between these sheets and the walls, and also so prevent such adhesion by the force of the flowing aerated fluid from these perforations.

The top edges of side walls 2 and 2*a* are rabbetted as shown at 36, the ledge 38 formed by each rabbetted portion being at the same level as the top of the overflow septum 20, so that the entire inner faces of the side walls are thus continually being washed; furthermore, the top ends 32 of the wire separators are below the surface of the washing fluid. This prevents a common cause of print contamination — if these points were above the level of the washing water, then as a print is being inserted into the washer, it will tend to come into contact with the top edge of wall 2 or 2*a*, or else with the top point of element 28, and leave some of the processing solution at these points, then when it is being withdrawn, the washed print can pick up some of this solution as it comes into contact with these same points, and thus be contaminated so that the print will show spots and be spoiled. This is prevented by the described construction with ordinary care on the part of the user in withdrawing the print vertically.

I claim:

1.

a. A washer for washing photographic material in sheet form comprising b. a tank having a pair of rectangular parallel vertical side walls and end walls, and a horizontal bottom wall and open at the top, c. a horizontal septum within said tank parallel to and spaced from the bottom wall to provide between itself and said bottom wall a single fluid distribution manifold, said septum being perforated with a large number of spaced small perforations for the passage of water, d. a fluid supply means for supplying to said manifold a continuous stream of water under pressure sufficient for said stream to rise through said perforations to fill the tank, e. a vertical septum near one of said end walls and parallel thereto, in water-tight edge contact with the two side walls and the bottom wall, the top edge of said vertical septum being below the top edges of the tank so that water rising in the tank flows over the top of said vertical septum and into the space between said vertical septum and its adjacent end wall without spilling over the top of the tank;

f. a fluid outlet nozzle near the bottom of said vertical space for continuous removal of said overflow water from from the tank when the tank is supplied with said continuous stream of water;

g. said horizontal septum being provided with a number of spaced parallel rows of wire receiving apertures;

h. a number of sheet separating elements each shaped like an inverted U, made of stiff wire of a thickness so that the end of the U can fit freely but snugly into said wire receiving apertures;

i. said sheet separating elements being fitted into at least some of said apertures to form at least two parallel rows of said separating elements spaced sufficiently to support between them a sheet of photographic material such as a photo print on edge for washing;

j. said small perforations being located immediately adjacent said apertures and in line with a row of the U-shaped elements.

2. The invention according to claim 1, said U-shaped wire elements being pointed at the bight rather than rounded, so as to make insertion of sheets easier.

3. The invention according to claim 2, the tops of said wire elements being below the overflow level of flowing water to prevent contamination of the prints.

4. The invention according to claim 3, adjacent ones of said U-shaped elements in a line of said elements being spaced sufficiently far apart so that a user's hand can be inserted therebetween for placement or recovery of a small sheet of photographic material.

5. The invention according to claim 4, the top edges of each of the side walls being rabbetted to form a ledge on the inner side, which ledge is at such a level that the edge of the ledge will be washed in running water during operation and thus not retain any contaminant from a print being washed.

6. The invention according to claim 5, and a series of narrow vertical ridges protruding from the inner faces of the side walls to prevent adhesion of a sheet being washed to said faces, and at least one of said small perforations laterally adjacent each of said ridges to provide a stream of aerated washing fluid between a sheet of photographic material and an adjacent wall face.

* * * * *